US010631636B2

(12) United States Patent
Schwenke

(10) Patent No.: US 10,631,636 B2
(45) Date of Patent: Apr. 28, 2020

(54) EXTENDABLE TABLE SYSTEM

(71) Applicant: Robert Schwenke, Discovery Bay, CA (US)

(72) Inventor: Robert Schwenke, Discovery Bay, CA (US)

( * ) Notice: Subject to any disclaimer, the term of this patent is extended or adjusted under 35 U.S.C. 154(b) by 0 days.

(21) Appl. No.: 16/247,421

(22) Filed: Jan. 14, 2019

(65) Prior Publication Data

US 2019/0142157 A1 May 16, 2019

(51) Int. Cl.

| | |
|---|---|
| ***A47B 87/00*** | (2006.01) |
| ***A47B 1/04*** | (2006.01) |
| ***A47B 3/08*** | (2006.01) |
| *A47B 13/02* | (2006.01) |

(52) U.S. Cl.

CPC ..... *A47B 87/002* (2013.01); *A47B 1/04* (2013.01); *A47B 3/08* (2013.01); *A47B 2013/024* (2013.01)

(58) Field of Classification Search

CPC ..... A47B 87/002; A47B 1/04; A47B 1/08; A47B 3/08

USPC ..... 108/64, 65, 66

See application file for complete search history.

(56) References Cited

U.S. PATENT DOCUMENTS 2,694,611 A * 11/1954 Lorber ..... A47B 96/025 108/67
2,705,179 A * 3/1955 Hodgin ..... A47B 1/00 428/609
3,002,787 A * 10/1961 Ziegenfuss ..... A47C 1/124 297/249
3,714,906 A * 2/1973 Finestone ..... A47B 7/02 108/64
5,146,855 A * 9/1992 Morgan ..... A47B 1/04 108/150
5,341,750 A * 8/1994 Fuchs ..... A47B 87/002 108/64
5,485,795 A * 1/1996 Williams ..... A47B 1/04 108/64
D373,915 S * 9/1996 Lobl ..... D6/696.3
5,568,775 A * 10/1996 Rizzi ..... A47B 87/002 108/64
5,673,631 A * 10/1997 Guns ..... A47B 87/002 108/64
5,943,966 A * 8/1999 Machado ..... A47B 87/002 108/64
5,967,058 A * 10/1999 Ambrose ..... A47B 13/10 108/64
5,988,077 A * 11/1999 Balderi ..... A47B 87/002 108/64
6,041,721 A * 3/2000 Weston ..... E05C 19/14 108/64
6,161,487 A * 12/2000 Chang ..... A47B 17/065 108/50.01
7,509,913 B1 * 3/2009 Eagle ..... A47B 13/08 108/64
D618,474 S * 6/2010 Maddadi ..... D6/644
(Continued)

*Primary Examiner* — Jose V Chen

(74) *Attorney, Agent, or Firm* — Barry Choobin; Patent 360

(57) ABSTRACT

The embodiments herein provide a table assembly comprising a set of tables and a plurality of extension members, each extension member configured to be inserted between two tables positioned adjacent to each other such that the extension member when inserted to be in a coplanar relationship in a horizontal plane along with adjacent tables forms an extended table system.

7 Claims, 2 Drawing Sheets

(56) References Cited

U.S. PATENT DOCUMENTS

| | | | | |
|---|---|---|---|---|
| D778,652 | S * | 2/2017 | Siebert | D6/707.15 |
| 2005/0045073 | A1* | 3/2005 | Wasley | A47B 17/033 108/64 |
| 2006/0180055 | A1* | 8/2006 | Mulmed | A47B 87/007 108/64 |
| 2008/0210142 | A1* | 9/2008 | Dewaard | A47B 13/021 108/64 |

* cited by examiner

EXTENDABLE TABLE SYSTEM

BACKGROUND

Technical Field

The embodiments herein generally relate to a convertible table system. More particularly, the embodiments herein describe a mechanism of converting a set of tables into an extended table system.

Description of the Related Art

The currently available mechanisms for attaching tables to obtain an extended table system include need for physical attachment to the existing tables. Such physical attachments need lot of effort in mounting for extension and dismounting for retraction. Further, seamless extension seems to be a mirage to achieve.

Hence, there is a need for providing an extended table system that is easy to extend and retract and achieves extension seamlessly.

The abovementioned shortcomings, disadvantages and problems are addressed herein and which will be understood by reading and studying the following specification.

OBJECT OF THE EMBODIMENTS HEREIN

The primary object of the embodiments herein is to provide an extendable table system.

Another object of the embodiments herein is to provide an extension member that when inserted between two tables forms an extended table system.

Yet another object of the embodiments herein is to provide an extension member that forms an extended table system in a seamless manner.

Yet another object of the embodiments herein is to provide an extendable table system that is easy to configure and retract.

These and other objects and advantages of the embodiments herein will become readily apparent from the following summary and the detailed description taken in conjunction with the accompanying drawings.

SUMMARY

The following details present a simplified summary of the embodiments herein to provide a basic understanding of the several aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The other objects and advantages of the embodiments herein will become readily apparent from the following description taken in conjunction with the accompanying drawings.

The various embodiments herein provide a table assembly comprising a set of tables and a plurality of extension members, each extension member configured to be inserted between two tables positioned adjacent to each other such that the extension member when inserted to be in a coplanar relationship in a horizontal plane along with adjacent tables forms an extended table system.

According to an embodiment herein, a convertible table system comprising a set of tables comprising at least two tables positioned adjacent to each other and at least one extension member comprising two parts, the extension member when inserted between the two tables positioned adjacent to each other transforms the two tables into an enlarged table system, wherein the extension member is configured for holding the two tables in coplanar relationship in a horizontal plane.

According to an embodiment herein, each table in the set of tables comprises a base for supporting the table and a table top pivotally mounted and secured to the base at a fixed position in a horizontal plane.

According to an embodiment herein, the extension member comprises at least one fastening device configured for coupling the extension member to the table tops of the adjacent tables.

According to an embodiment herein, the fastening device is a clip.

According to an embodiment herein, the clip is structured to form a surface between the adjacent table tops and the extension member positioned in between the table tops.

According to an embodiment herein, the clip is structured to wrap about half of the table top located on either side of the extension member.

According to an embodiment herein, the extension member is made of poly vinyl chloride.

According to an embodiment herein, the extension member is manufactured using one of injection or molding process.

According to an embodiment herein, the extendable table system further comprises a metal strap hinge riveted to the edges at midpoint of the extension member.

According to an embodiment herein, the metal strap hinge comprises a stainless steel strap hinge.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects features and advantages will occur to those skilled in the art from the following description of the preferred embodiment and the accompanying drawings in which.

Although the specific features of the embodiments herein are shown in some drawings and not in others. This is done for convenience only as each feature may be combined with any or all of the other features in accordance with the embodiment herein.

DETAILED DESCRIPTION OF THE EMBODIMENTS HEREIN

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a table assembly comprising a set of tables and a plurality of extension members, each extension member configured to be inserted between two tables positioned adjacent to each other such that the extension member when inserted to be in a coplanar relationship in a horizontal plane along with adjacent tables forms an extended table system.

The general purpose of this invention is to provide "extension members". Each extension members is a two part structure, which folds out to attach/join two tables to get one long table for a bigger group. The "extension members" are supported by the table tops with fastening members such as clips. The clips are shaped to form a surface between the table and the extension members. The invention eliminates the need for any physical attachment to the existing tables due to the shape of the table insert wrapping around half of the table on each side and the weight of the table insert is enough to hold the same in place.

Figure 1:
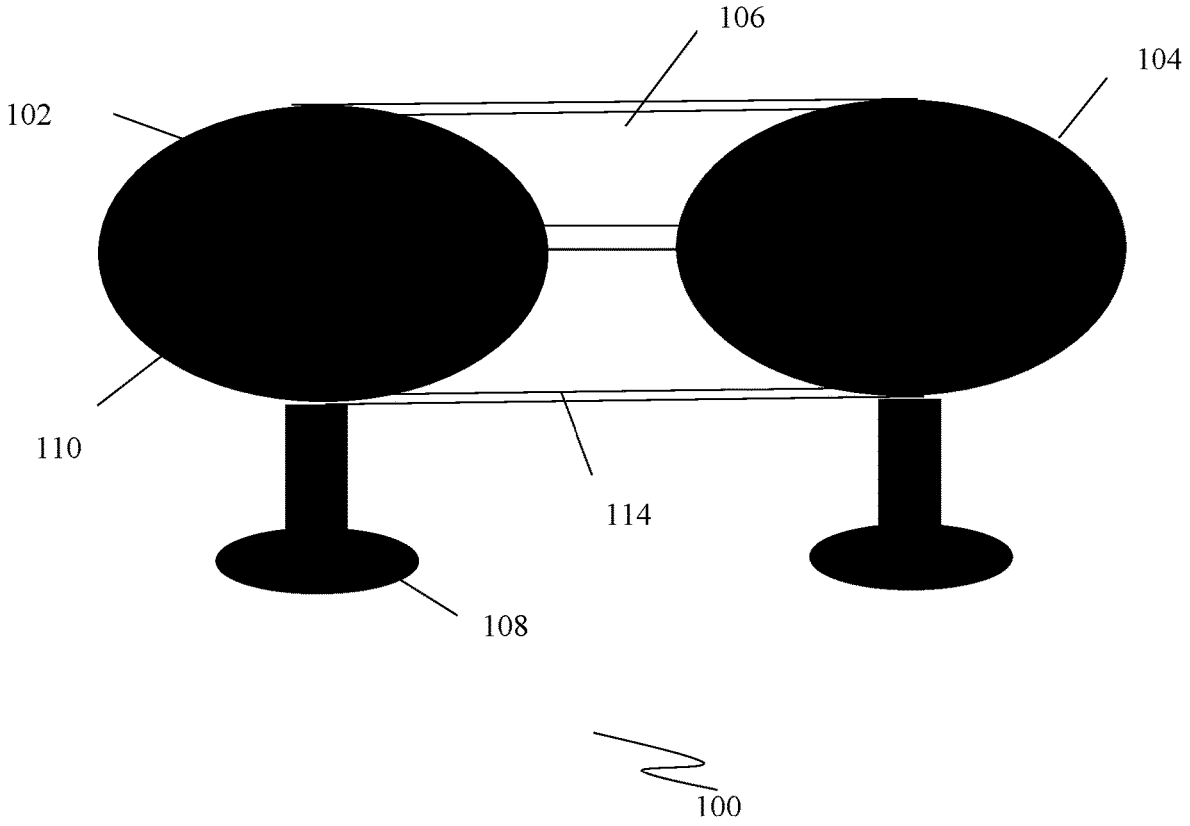
FIG. 1 illustrates a perspective view of an extendable table system, according to an embodiment herein.
Figure 2:
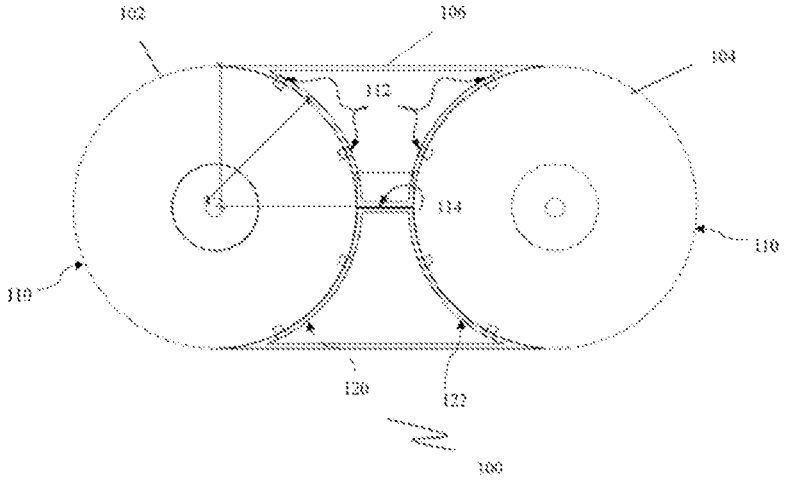
FIG. 2 illustrates a top view of the extendable table system shown in FIG. 1, according to an embodiment herein.

Accordingly, in one embodiment, as shown in FIG. 1 and FIG. 2, an extendable table system is disclosed. The extendable table system comprises a set of tables 102 and 104 comprising at least two tables 102 and 104 positioned adjacent to each other and at least one extension member 106 comprising two parts, the extension member 106 when inserted between the two tables 102 and 104 positioned adjacent to each other transforms the two tables 102 and 104 into an enlarged table system. Further, the extension member 106 is configured for holding the two tables 102 and 104 in coplanar relationship in a horizontal plane.

Each table in the set of tables 102 and 104 comprises a base 108 for supporting the table; and a table top 110 pivotally mounted and secured to the base 108 at a fixed position in a horizontal plane.

The extension member 106 is circumferentially disposed to the table top 110*s* of each of the tables 102 and 104 positioned adjacent to the extension member 106.

The extension member 106 shown in FIG. 2 is having a top concave side 120, a bottom concave side 122, a left side and a right side. The concaves sides are shaped and sized to abut to the side of the table top 110. The extension member 106 comprises a plurality of fastening device 112 configured for coupling the extension member 106 to the table top 110 of the adjacent tables 102 and 104. Further shown in FIG. 2 is the fastening device 112 coupled to the top concave side 120 and the bottom concave side 122. In one exemplary embodiment, the fastening device 112, also referred herein as clamp, is a clip. The extension member 106 is structured to wrap about half of the table top 110 located on either side of the extension member 106 so as to form a co-planar horizontal surface between both the adjacent table top 110 and the extension member 106 positioned in between the two table top 110.

The clips 112 are fabricated from stainless steel. In one exemplary embodiment, each clip is two inches wide and extending out onto the table top 110 and made to wrap around the edge of the table system 100. Each clip is attached by rivets in order to secure the position.

In one exemplary embodiment, the extension member 106 is made of poly vinyl chloride that is manufactured using one of injection or molding process. The molded or injected plastic used for fabricating the extension member 106 enhances the durability and portability of the extendable table system.

The system further comprises a metal strap hinge 114 riveted to the edges at midpoint of the extension member 106. In one exemplary embodiment, the metal strap hinge 114 comprises a stainless-steel strap hinge 114. Skilled artisans shall however appreciate that other metals suitable for the application may also be employed.

In one exemplary embodiment, the two parts of the table system 100 are connected with a twelve-inch-long stainless-steel strap hinge 114 riveted to the edges at midpoint of the table system 100 for flexibility of installation and storage.

The advantages of the embodiments disclosed herein comprise an easy to extend and retract extended table system 100 that achieves extension seamlessly. Further, molded or injected plastic used for fabricating the extension member 106 enhances the durability and portability of the extendable table system. The stainless-steel strap hinge 114 riveted to the edges at midpoint of the table system 100 provides flexibility for installation and storage.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the appended claims.

It is also to be understood that the following claims are intended to cover all of the generic and specific features of the embodiments described herein and all the statements of the scope of the embodiments which as a matter of language might be said to fall there between.

What is claimed is:

1. A table extension system comprising:

an extension member, the extension member when inserted between two tables positioned adjacent to each other transforms the two tables into an enlarged table, each of the two tables having a table top, the table top having a first top surface and a side, the extension member having a second top surface, a top concave side, a bottom concave side, a left side and a right side, the top concave side and the bottom concave side are sized and shaped to abut to the side of each of the two tables; and a plurality of clamps coupled to the top concave side and the bottom concave side, the plurality of clamps configured to clamp to the side of each of the two tables for securing the table extension system to the two tables;

wherein the first top surface of each of the two tables and the second surface are coplanar in a horizontal plane.

2. The system as claimed in claim 1, wherein the clamps is a clip.

3. The system as claimed in claim 2, wherein the clip is structured to grip the side of each of the two table over the first top surface and a bottom surface of each of the two tables.

4. The system as claimed in claim 1, wherein the extension member is made of poly vinyl chloride.

5. The system as claimed in claim 1, wherein the extension member is manufactured using one of injection or molding process.

6. The system as claimed in claim 1, wherein the table extension system is comprised of two parts foldably coupled through a hinge riveted to the edges at midpoint of the extension member.

7. The system of claim 1, wherein the table top of each of the two tables is round in shape, the table top of each of the two tables having a first radius, the top concave side is a top concave semicircle side have a second radius, the bottom concave side is a bottom concave semicircle side having a second radius, wherein the first radius and the second radius are same.

* * * * *